US011263874B1

(12) United States Patent
Armentrout et al.

(10) Patent No.: US 11,263,874 B1
(45) Date of Patent: Mar. 1, 2022

(54) CASH CASSETTE NOTE SEPARATION TECHNIQUE

(71) Applicant: Nautilus Hyosung America, Inc., Irving, TX (US)

(72) Inventors: Wesley K. Armentrout, Columbus, OH (US); Kyuno Youn, Seoul (KR); Seungtae Paik, Seoul (KR)

(73) Assignee: Nautilus Hyosung America, Inc., Irving, TX (US)

( * ) Notice: Subject to any disclaimer, the term of this patent is extended or adjusted under 35 U.S.C. 154(b) by 0 days.

(21) Appl. No.: 17/381,711

(22) Filed: Jul. 21, 2021

Related U.S. Application Data

(60) Provisional application No. 63/218,753, filed on Jul. 6, 2021.

(51) Int. Cl.
*G07F 19/00* (2006.01)

(52) U.S. Cl.
CPC ..... *G07F 19/203* (2013.01)

(58) Field of Classification Search
CPC ..... G07F 19/203
USPC ..... 235/7 R
See application file for complete search history.

(56) References Cited

U.S. PATENT DOCUMENTS

| | | | | |
|---|---|---|---|---|
| 5,271,613 | A * | 12/1993 | Hain | B65H 1/025 271/3.12 |
| 2004/0164168 | A1* | 8/2004 | Washington | G07D 11/13 235/486 |
| 2006/0157916 | A1* | 7/2006 | Ahn | B65H 1/12 271/145 |
| 2015/0251861 | A1* | 9/2015 | Go | G07D 11/13 271/160 |
| 2016/0023854 | A1* | 1/2016 | Plotzitzka | G07D 11/12 271/163 |
| 2017/0301171 | A1* | 10/2017 | Schwartz | G07D 11/28 |

* cited by examiner

*Primary Examiner* — Daniel A Hess
(74) *Attorney, Agent, or Firm* — Quinn IP Law

(57) ABSTRACT

A cash cassette includes a housing, a pick-up module, a push plate, and one or more separator modules. The housing has a dispense end, a floor, and a size suitable to store multiple notes. Each note has a particular note edge. The pick-up module is disposed at the dispense end of the housing and is configured to transfer one note at a time out of the housing. The push plate is movably disposed inside the housing and is configured to bias the notes against the pick-up module. The separator modules are disposed on the floor of the housing proximate to the pick-up module. Each separator module has a rough surface that engages the particular note edges as the notes are pushed onto the separator modules by the push plate. The rough surface loosens individual notes from each other as the notes move across the separator modules toward the pick-up module.

20 Claims, 8 Drawing Sheets

CASH CASSETTE NOTE SEPARATION TECHNIQUE

CROSS-REFERENCE TO RELATED APPLICATIONS

This application claims the benefit of U.S. Provisional Application No. 63/218,753, filed Jul. 6, 2021, which is hereby incorporated by reference in its entirety.

INTRODUCTION

The present disclosure relates to a system and a method for a cash cassette having a note separation technique.

Fresh bundles of new notes are regularly loaded into automatic teller machines. The new notes are prone to sticking to each other while the automatic teller machine attempts to dispense the notes to a customer. Sensors in the automatic teller machine check the notes being prepared for delivery to verify that a correct number of notes have been counted. If some new notes stick together during the process, the sticky notes are routed to a reject box for manual separation and restocking back into the automatic teller machine.

What is desired is a technique for separating individual notes in a stack of notes prior to the notes leaving the cash cassette.

SUMMARY

A cash cassette is disclosed herein. The cash cassette includes a housing, a pick-up module, a push plate, and one or more separator modules. The housing has a dispense end, a floor, and a size suitable to store a plurality of notes. Each of the plurality of notes has a particular note edge. The pick-up module is disposed at the dispense end of the housing, and is configured to transfer one note at a time among the plurality of notes out of the housing. The push plate is movably disposed inside the housing, and is configured to bias the plurality of notes against the pick-up module.

The one or more separator modules are disposed on the floor of the housing proximate to the pick-up module. Each of the one or more separator modules has a rough surface. The rough surface engages the particular note edge of the plurality of notes as the plurality of notes are pushed onto the one or more separator modules by the push plate. The rough surface loosens individual notes among the plurality of notes from each other as the plurality of notes move across the one or more separator modules toward the pick-up module.

In one or more embodiments, the cash cassette includes a note guide disposed on the floor of the housing between the pick-up module and the one or more separator modules. The note guide has an alignment surface that contacts the particular note edge of the plurality of notes. The alignment surface aligns the plurality of notes to the pick-up module.

In one or more embodiments of the cash cassette, a step exists between the rough surface of the one or more separator modules and the alignment surface of the note guide. The particular note edge of the plurality of notes transitions over the step as the plurality of notes move toward the pick-up module.

In one or more embodiments of the cash cassette, the one or more separator modules is two separator modules.

In one or more embodiments of the cash cassette, the rough surface of each of the one or more separator modules includes one or more nonplanar ridges oriented perpendicular to the dispense end.

In one or more embodiments of the cash cassette, each of the one or more nonplanar ridges comprises a series of shapes that loosen the individual notes.

In one or more embodiments of the cash cassette, the one or more nonplanar ridges is two nonplanar ridges disposed on opposite sides of each of the one or more separator modules, and at a same distance from the dispense end.

In one or more embodiments of the cash cassette, the rough surface of each of the one or more separator modules includes a plurality of hooks attached to a strip. The plurality of hooks form the rough surface that loosen the individual notes.

In one or more embodiments of the cash cassette, the cash cassette is removably connectable to a cash dispenser unit of an automatic teller machine.

A method for dispensing from a cash cassette is provided herein. The method includes storing a plurality of notes in a housing of the cash cassette. The housing has a dispense end and a floor. Each of the plurality of notes has a particular note edge. The method includes biasing the plurality of notes toward a pick-up module with a push plate. The pick-up module is disposed inside the housing at the dispense end. The push plate is moveably disposed inside the housing.

The method further includes engaging the particular note edge of the plurality of notes with a rough surface on each of one or more separators modules as the plurality of notes are pushed onto the one or more separator modules by the push plate. The one or more separator modules are disposed on the floor of the housing proximate to the pick-up module. The method includes loosening individual notes among the plurality of notes from each other with the rough surface as the plurality of notes move across the one or more separator modules toward the pick-up module, and transferring one note at a time among the plurality of notes out of the housing with the pick-up module.

In one or more embodiments, the method includes aligning the plurality of notes to the pick-up module with a note guide. The note guide is disposed on the floor of the housing between the pick-up module and the one or more separator modules. The note guide has an alignment surface that contacts the particular note edge of the plurality of notes.

In one or more embodiments, the method includes transitioning the particular note edge of the plurality of notes over a step between the rough surface of the one or more separator modules and the alignment surface of the note guide as the plurality of notes move toward the pick-up module.

In one or more embodiments of the method, the one or more separator modules is two separator modules.

In one or more embodiments of the method, the rough surface of each of the one or more separator modules includes one or more nonplanar ridges oriented perpendicular to the dispense end.

In one or more embodiments of the method, the loosening of the individual notes includes loosening the individual notes of the plurality of notes with a series of shapes on each of the one or more nonplanar ridges.

In one or more embodiments of the method, the one or more nonplanar ridges is two nonplanar ridges disposed on opposite sides of each of the one or more separator modules, and at a same distance from the dispense end.

In one or more embodiments of the method, the loosening of the individual notes includes loosening the individual notes of the plurality of notes with a plurality of hooks that form the rough surface.

A cash dispenser unit is provided herein. The cash dispenser unit includes a body module, a feed module, and one or more cash cassettes. The body module is configured to dispense one or more notes of a plurality of notes. Each of the plurality of notes has a particular note edge. The feed module is connectable to the body module, and is configured to transfer the one or more notes to the body module. The one or more cash cassettes are removably connectable to the feed module.

Each of the one or more cash cassettes includes a housing, a pick-up module, a push plate and one or more separator modules. The housing has a dispense end, a floor, and a size suitable to store the plurality of notes. The pick-up module is disposed at the dispense end of the housing, and is configured to transfer one note at a time among the plurality of notes out of the housing to the feed module. The push plate is movably disposed inside the housing, and is configured to bias the plurality of notes against the pick-up module. The one or more separator modules are disposed on the floor of the housing proximate to the pick-up module. Each of the one or more separator modules has a rough surface. The rough surface engages the particular note edge of the plurality of notes as the plurality of notes are pushed onto the one or more separator modules by the push plate. The rough surface loosens individual notes among the plurality of notes from each other as the plurality of notes move across the one or more separator modules toward the pick-up module.

In one or more embodiments, the cash dispenser unit includes a present module connectable to the body module, and is configured to transfer the one or more notes from the body module out of the cash dispenser unit.

In one or more embodiments of the cash dispenser unit, the body module, the feed module, and the present module form part of an automatic teller machine.

The above features and advantages and other features and advantages of the present disclosure are readily apparent from the following detailed description of the best modes for carrying out the disclosure when taken in connection with the accompanying drawings.

DETAILED DESCRIPTION

Embodiments of the disclosure generally provide one or more separator modules along a floor of a cash cassette to fluff or fan brand new, nearly new, or lightly circulated notes. By placing the separator modules near an exit port of the cash dispenser cassette, sufficient separation (or dislodging) of the notes from each other may be achieved such that a pick-up wheel may remove one note at a time from a stack of notes with an improved reliability. In particular, the separator modules aid in proper dispensing of newer notes from the cash cassettes in automatic teller machines resulting in lower rates of rejection where two or more notes are improperly removed simultaneously from a cash cassette.

Figure 1:
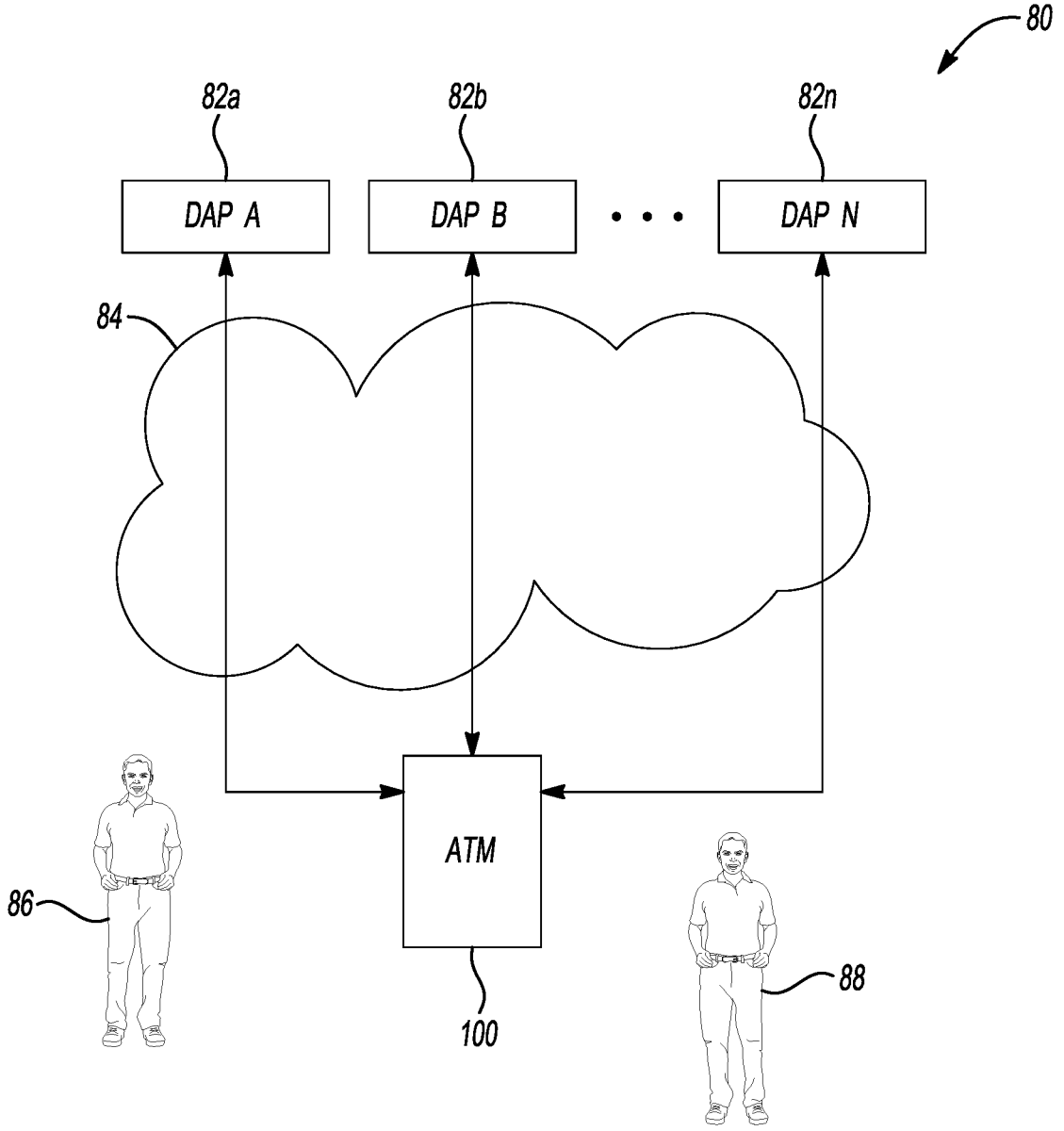
FIG. 1 is a schematic diagram illustrating a context of a system in accordance with one or more exemplary embodiments.

Referring to FIG. 1, a schematic diagram illustrating a context of a system 80 is shown in accordance with one or more exemplary embodiments. The system 80 generally includes multiple dispense authorization parties (DAP) 82*a*-82*n*, a communication network 84, a technician 86, multiple customers (one shown) 88, and one or more automatic teller machines (one shown) 100. The system 80 implements a technique for separating individual notes in stacks of notes stored in one or more cash cassettes within the automatic teller machines 100.

Each dispense authorization party 82*a*-82*n* is a bank, a network, a financial institution, or a software vendor. The dispense authorization parties 82*a*-82*n* are parties to one or more financial transactions that may authorize dispense operations from the automatic teller machine 100. The dispense authorization parties 82*a*-82*n* may be remotely located from the automatic teller machine 100. In some situations, a dispense authorization party 82*a*-82*n* may be inside a particular building while the automatic teller machine 100 is located elsewhere inside or outside the particular building. In other situations, the automatic teller machine 100 may be miles to hundreds of miles or more away from a nearest dispense authorization party 82*a*-82*n*. The dispense authorization parties 82*a*-82*n* are in electronic communication with the automatic teller machine 100 through the communication network 84.

The communication network 84 implements one or more networks. The communication network 84 is operational to provide bidirectional communications between the automatic teller machine 100 and the dispense authorization parties 82*a*-82*n*. The communication network 84 may include, but is not limited to, the Internet, wide area networks, local area networks, wired networks, wireless networks, optical network, and radio-frequency networks. Other types of networks may be implemented to meet the design criteria of a particular application.

The technician 86 is a person authorized to perform service on the automatic teller machine 100. The technician 86 generally has access to an interior of the automatic teller machine 100 to perform repairs, perform maintenance operations, perform setup operations, remove envelopes deposited into the machine, and/or add notes to the machine.

The customer 88 is a person authorized to utilize the automatic teller machine 100. The customer 88 generally has an account with one or more of the dispense authorization parties 82*a*-82*n*. The customer 88 may perform a variety of banking operations using the automatic teller machine 100. The banking operations generally include, but are not limited to, withdrawal of notes (e.g., cash or bills), depositing checks, depositing cash, transferring funds between accounts, and checking account balances.

The automatic teller machine 100 implements an automated banking device that enables the customer 88 to access personal and/or business accounts anytime of the day. For a cash withdrawal transaction, the automatic teller machine 100 communicates with a corresponding one of the dispense authorization parties 82*a*-82*n* to verify that the customer 88 has sufficient funds in a targeted account to cover a withdrawal request. If the corresponding dispense authorization party 82*a*-82*n* approves the withdrawal, the automatic teller machine 100 dispenses (or gives) the requested amount to the customer 88.

Figure 2:
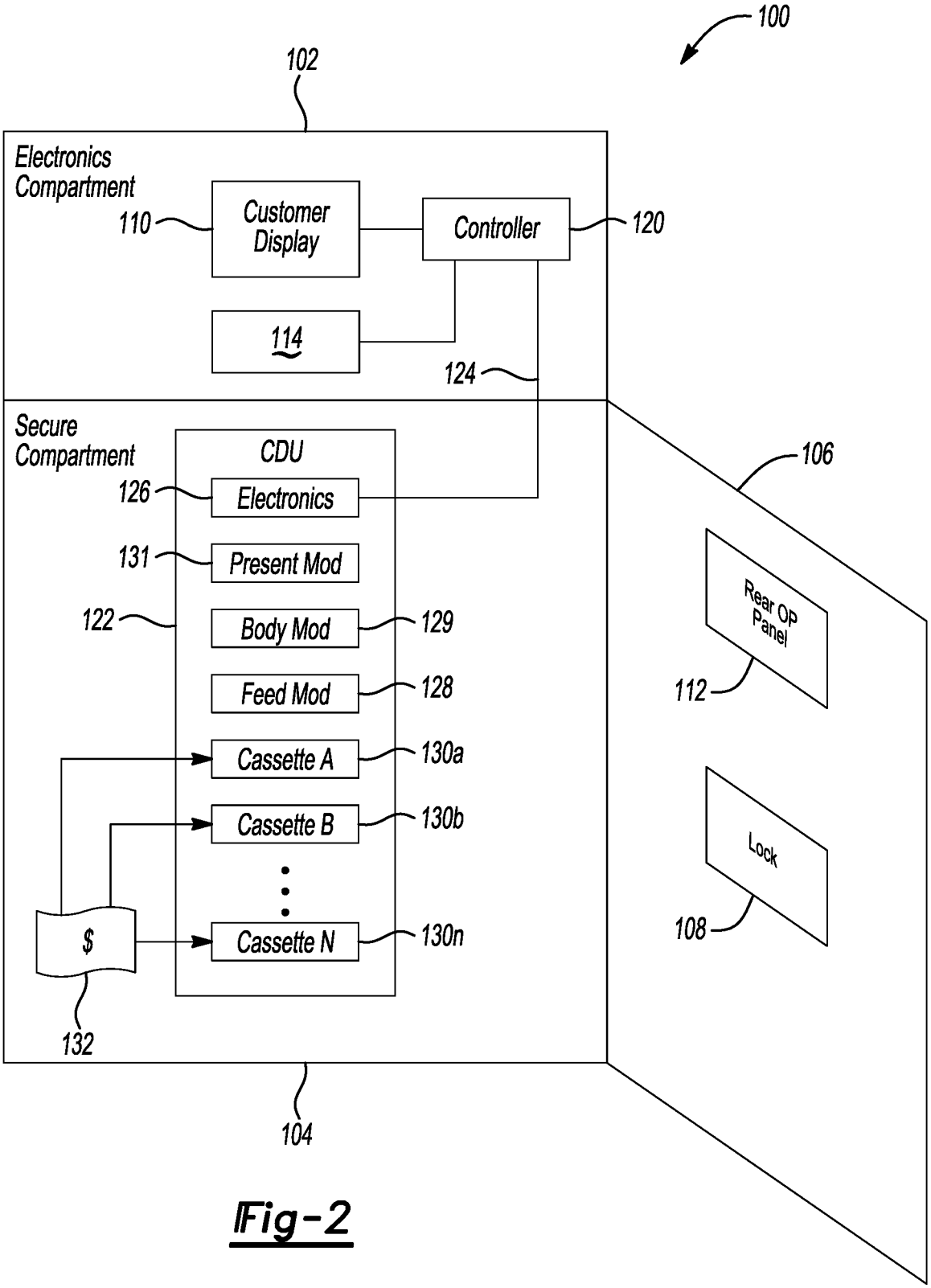
FIG. 2 is a perspective diagram of an automatic teller machine in accordance with one or more exemplary embodiments.

Referring to FIG. 2, a perspective diagram of an example implementation of the automatic teller machine 100 is shown in accordance with an exemplary embodiment. The automatic teller machine 100 generally includes an electronics compartment 102 and a secure compartment 104. A door 106 with a lock 108 prevent access to the secure compartment 104 from unauthorized people. The technician 86 is capable of opening the lock 108 on the door 106 to access an interior of the secure compartment 104.

The electronics compartment 102 houses a controller 120, a customer display 110, a rear operator panel 112, and a card reader 114. Other devices may be housed in the electronics compartment 102. The controller 120 is configured to control the overall operations of the automatic teller machine 100. The controller 120 is in bidirectional communication with the dispense authorization parties 82*a*-82*n* via the communication network 84. The controller 120 is also in bidirectional communication with the electronics circuit 126 via a local communication bus 124.

The secure compartment 104 houses a cash dispenser unit 122 and a local communication bus 124. Other devices may be housed in the secure compartment 104. The cash dispenser unit 122 includes an electronics circuit 126, a feed module 128, a body module 129, multiple cash cassettes 130*a*-130*n*, and a present module 131. The cash cassettes 130*a*-130*n* are configured to hold one or more notes 132.

The customer display 110 enables the customer 88 to enter banking transaction requests and provides visual and/or audio information to the customer 88. The rear operator panel 112 enables the technician 86 to perform maintenance and setup operations on the automatic teller machine 100 without accessing the electronics compartment 102 or the secure compartment 104. The card reader 114 is operational to read an electronic/magnetic banking card that partially verifies an identity of the customer 88.

The controller 120 implements one or more computers. The controller 120 is operational to communicate with the dispense authorization parties 82*a*-82*n* via the communication network 84 and the cash dispenser unit 122 via the local communication bus 124. The controller 120 is configured to interact with the customer 88 via the customer display 110 and the card reader 114. The controller 120 also interacts with the technician 86 via the rear operator panel 112 and a variety of interfaces on a side of the controller 120. The controller 120 provides a level of defense against attacks on the system 80 by performing some validity checks before a cash dispense operation is sent to the cash dispenser unit 122.

The cash dispenser unit 122 implements a hardware-based device capable of executing financial transactions. The cash dispenser unit 122 is operational to store and dispense the notes 132 in response to commands received from the controller 120 via the local communication bus 124. The cash dispenser unit 122 is also operational to receive and store envelopes, notes, and checks deposited by the customer 88 into the automatic teller machine 100.

The local communication bus 124 implements a bidirectional electrical bus. The local communication bus 124 is operational to provide bidirectional command and data transfers between the controller 120 and the cash dispenser unit 122. In various embodiments, the local communication bus 124 may be a Universal Serial Bus, an RS-422 bus, or an Ethernet bus. Other types of buses may be implemented to meet the design criteria of a particular application.

The electronics circuit 126 implements local control of operations inside the cash dispenser unit 122. The electronics circuit 126 communicates bidirectionally with the controller 120 via the local communication bus 124. The electronics circuit 126 is operational to respond to commands from the controller 120 by validating the commands and subsequently acting on valid commands and rejecting invalid commands.

The feed module 128 is operational to transfer the notes 132 stored in the cash cassettes 130*a*-130*n* to body module 129. The feed module 128 is connectable to the cash cassettes 130*a*-130*n*. The feed module 128 is connectable to the body module 129.

The body module 129 implements a note detection, stacking and transfer mechanism. The body module 129 includes a high precision sensor that measures thicknesses of the notes 132 being transferred, and verifies if multiple notes 132 are stuck together. Where more than one note 132 has been requested, the body module 129 is operational to stack the requested notes 132 into a bundle. The body module 129 presents only "normal" notes 132 in the bundle to the customers 88 by filtering all of the "bad" notes 132 through a gating operation. The body module 129 is connectable to the feed module 128. The body module 129 is also connectable to the present module 131

The cash cassettes 130*a*-130*n* are operational to store the notes 132 loaded into the automatic teller machine 100. Under control of the electronics circuit 126, the cash cassettes 130*a*-130*n* may transfer the notes 132, one note 132 at a time, to the feed module 128 for presentation to the body module 129, the present module 131, and out to the customer 88. Each cash cassette 130*a*-130*n* is removably connectable to the feed module 128.

The present module 131 implements a transfer mechanism. The present module 131 generally provides the notes 132 out of the automatic teller machine 100 to the customers 88 with the notes 132 stacked in the body module 129. The present module 131 may also be operational to receive envelopes, cash and checks from the customer 88 for storage inside the secure compartment 104. The present module 131 is connectable to the body module 129.

Figure 3:
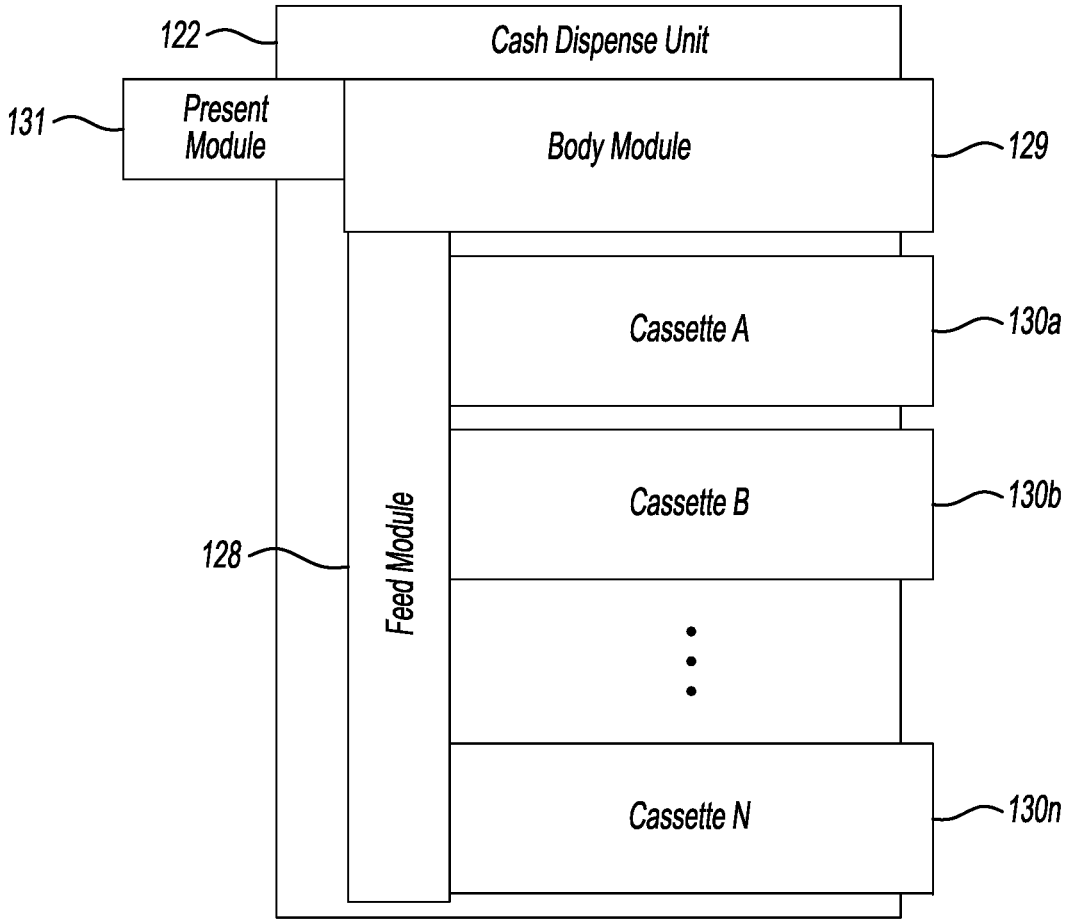
FIG. 3 is a cross-sectional diagram of a cash dispenser unit in accordance with one or more exemplary embodiments.

Referring to FIG. 3, a cross-sectional diagram of an example implementation of the cash dispenser unit 122 is shown in accordance with one or more exemplary embodiments. The cash dispenser unit 122 generally includes the feed module 128, the body module 129, the cash cassettes 130*a*-130*n*, and the present module 131.

Notes 132 (see FIG. 2) withdrawn from the cash cassettes 130*a*-130*n* are transported through the feed module 128 up to the body module 129. The body module 129 checks for multiple notes 132 received as if a single note 132. Where multiple notes 132 are to be dispensed, the body module 129 bundles the notes 132 then transfers the bundle to the present module 131. The present module 131 transfers the bundle of notes 132 to the customer 88.

Figure 4:
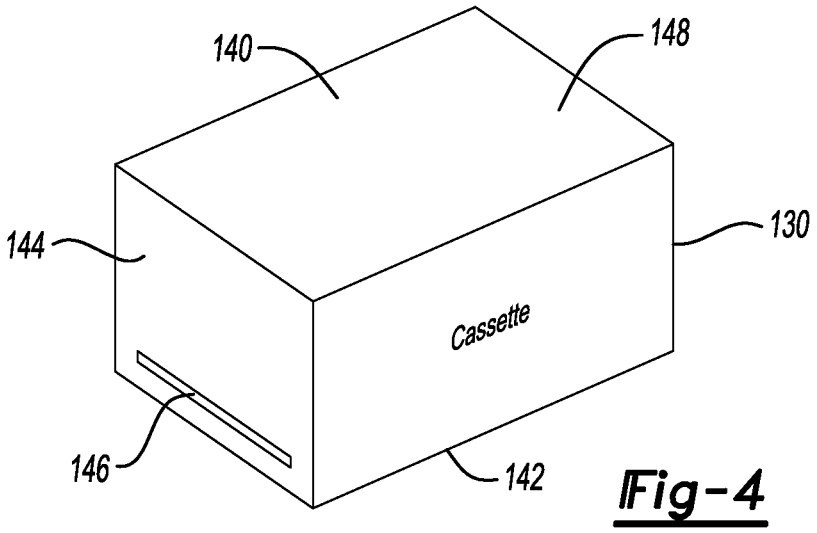
FIG. 4 is a perspective diagram of a cash cassette in the cash dispenser unit in accordance with one or more exemplary embodiments.

Referring to FIG. 4, a perspective diagram of an example implementation of a cash cassette 130 is shown in accordance with one or more exemplary embodiments. The cash cassette 130 may be representative of each of the cash cassettes 130*a*-130*n*. In various embodiments, the cash cassette 130 includes a housing 140 having a generally cuboid shape. While in a normal orientation in the cash dispenser unit 122, a bottom side of the housing 140 may be referred to as a floor 142. A short side of the housing 140 may be referred to as a dispense end 144. A dispense slot 146 is provided in the dispenser end 144 near the floor 142 to allow the notes 132 to be transferred out of the cash cassette 130 into the feed module 128. The housing 140 may have a size 148 sufficient to hold up to several hundreds of notes 132 at a time.

Figure 5:
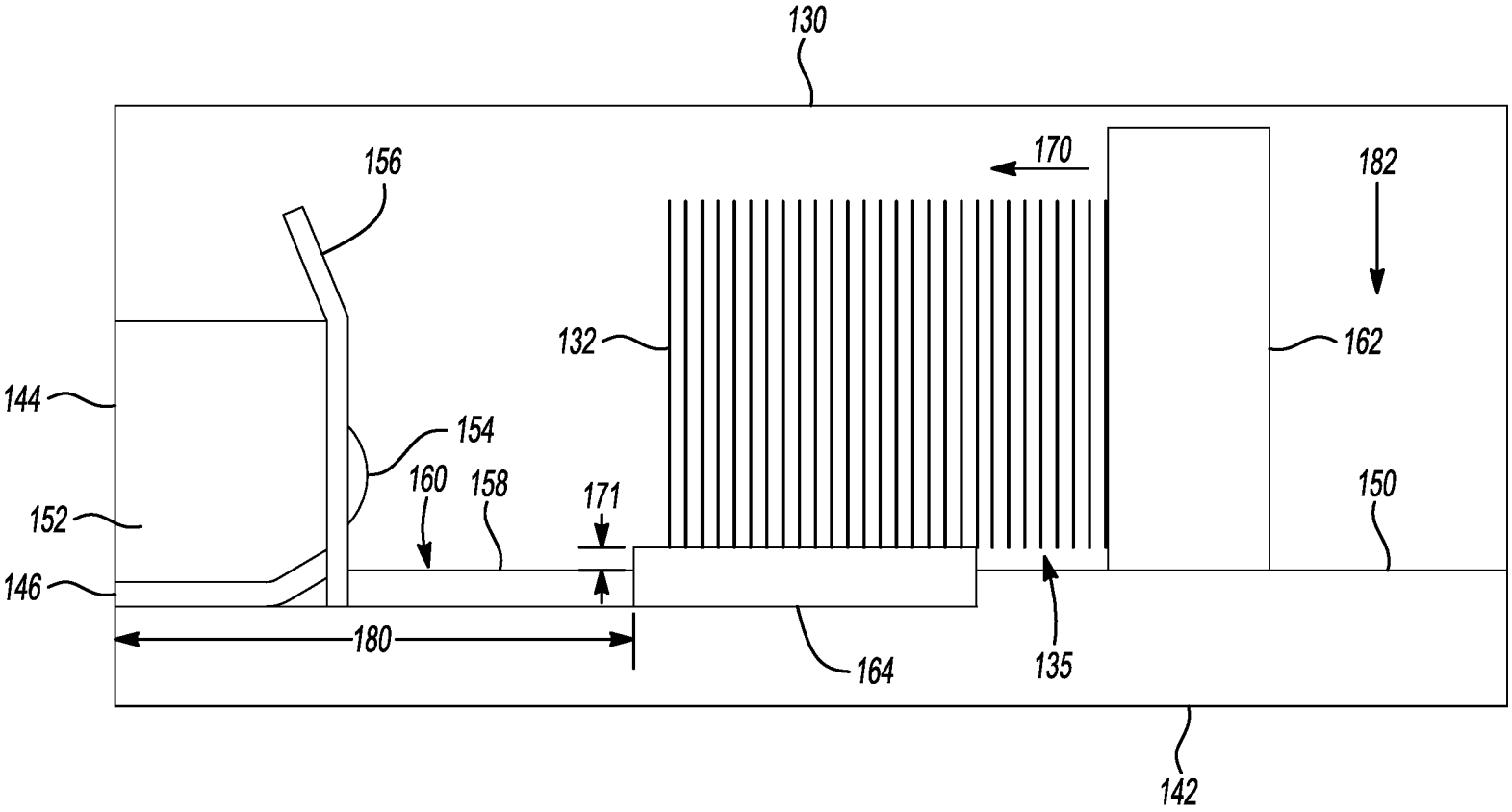
FIG. 5 is a side cross-sectional diagram of the cash cassette in accordance with one or more exemplary embodiments.

Referring to FIG. 5, a side cross-sectional diagram of an example implementation of the cash cassette 130 is shown in accordance with one or more exemplary embodiments. The cash cassette 130 generally includes the floor 142 with a floor surface 150, the dispense end 144 with the dispense slot 146, a pick-up module 152 with a pick-up wheel 154, an end plate 156, a note guide 158 with an alignment surface 160, a push plate 162, and a separator module 164. Notes 132 may be stored inside the cash cassette 130. Each note 132 has a particular note edge 135 (e.g., a bottom edge while stored in the cash cassette 130). Gravity 182 presses the notes 132 toward the floor 142 to hold the particular note edges 135 against the floor surface 150, a rough surface of the separator module 164, and the alignment surface 160 of the note guide 158.

The pick-up module 152 is disposed at the dispense end 144 of the cash cassette 130. The pick-up module 152 is operational to pull one note at a time from the stack of notes 132 stored in the cash cassette 130. The pick-up module 152 includes the pick-up wheel 154 that engages an end note 132 in the stack of notes 132. The pick-up wheel 154 is operational to transfer the end note 132 into the dispense slot 146 and out of the cash cassette 130.

The end plate 156 is disposed on the floor 142 of the cash cassette 130 adjoining the pick-up module 152. The end plate 156 implements a horizontal mechanical stop for the stack of notes 132. The notes 132 are pressed against the end plate 156 by the push plate 162.

The note guide 158 is disposed on the floor 142 of the cash cassette 130 adjoining the end plate 156. The note guide 158 is operational to hold several notes 132 at the end of the stack in the vertical direction. Gravity 182 holds the several notes 132 downward against the alignment surface 160 of the note guide 158.

The push plate 162 implements a spring-loaded sliding plate that is moveable inside the housing 140. The push plate 162 is operational to bias the stack of notes 132 against the end plate 156. The push plate 162 generally moves the stack of notes 132 in a bias direction 170 toward the dispense end 144 of the cash cassette 130.

The separator module 164 is disposed on the floor 142 of the cash cassette 130 adjoining the note guide 158. The separator module 164 is located a distance 180 from the dispense slot 146. The separator module 164 implements a device that helps separate and loosen the individual notes 132 in the stack of notes 132 from each other before the pick-up module 152 moves the end note 132 out of the cash cassette 130. A step 171 exists between a top surface of the separator module 164 and the alignment surface 160 of the note guide 158. The top surface of the separator module 164 is generally a few millimeters (e.g., 0.5 millimeters to 2 millimeters) further from the floor 142 than the alignment surface 160 of the note guide 158.

Figure 6:
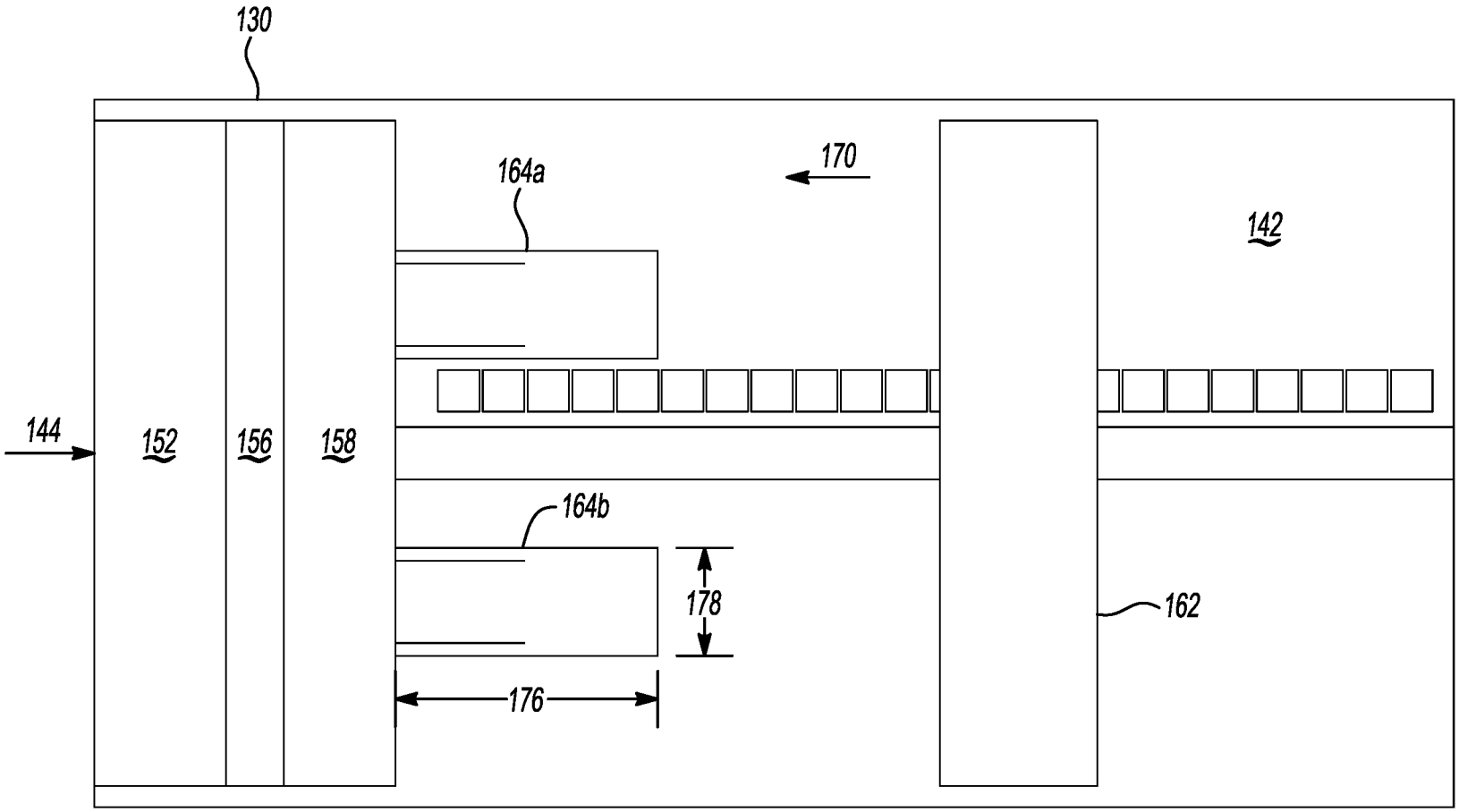
FIG. 6 is a planar diagram of the cash cassette in accordance with one or more exemplary embodiments.

Referring to FIG. 6, a planar diagram of an example implementation of the cash cassette 130 is shown in accordance with one or more exemplary embodiments. The cash cassette 130 may include the floor 142, the pick-up module 152, the end plate 156, multiple (e.g., two) separator modules 164*a*-164*b*, the note guide 158, and the push plate 162.

As illustrated, the first separator module 164*a* may be disposed alongside the second separator module 164*b* aligned along a line parallel to the dispense end 144. In some embodiments, a single separator module 164 may be implemented. Each separator module 164*a*-164*b* may have a module length 176 and a module width 178. In various embodiments, the module length 176 may range from approximately 20 millimeters to approximately 50 millimeters. The module width 178 may range from approximately 10 millimeters to approximately 30 millimeters. Other widths and/or lengths may be implemented to meet a design criteria of a particular application.

Figure 7:
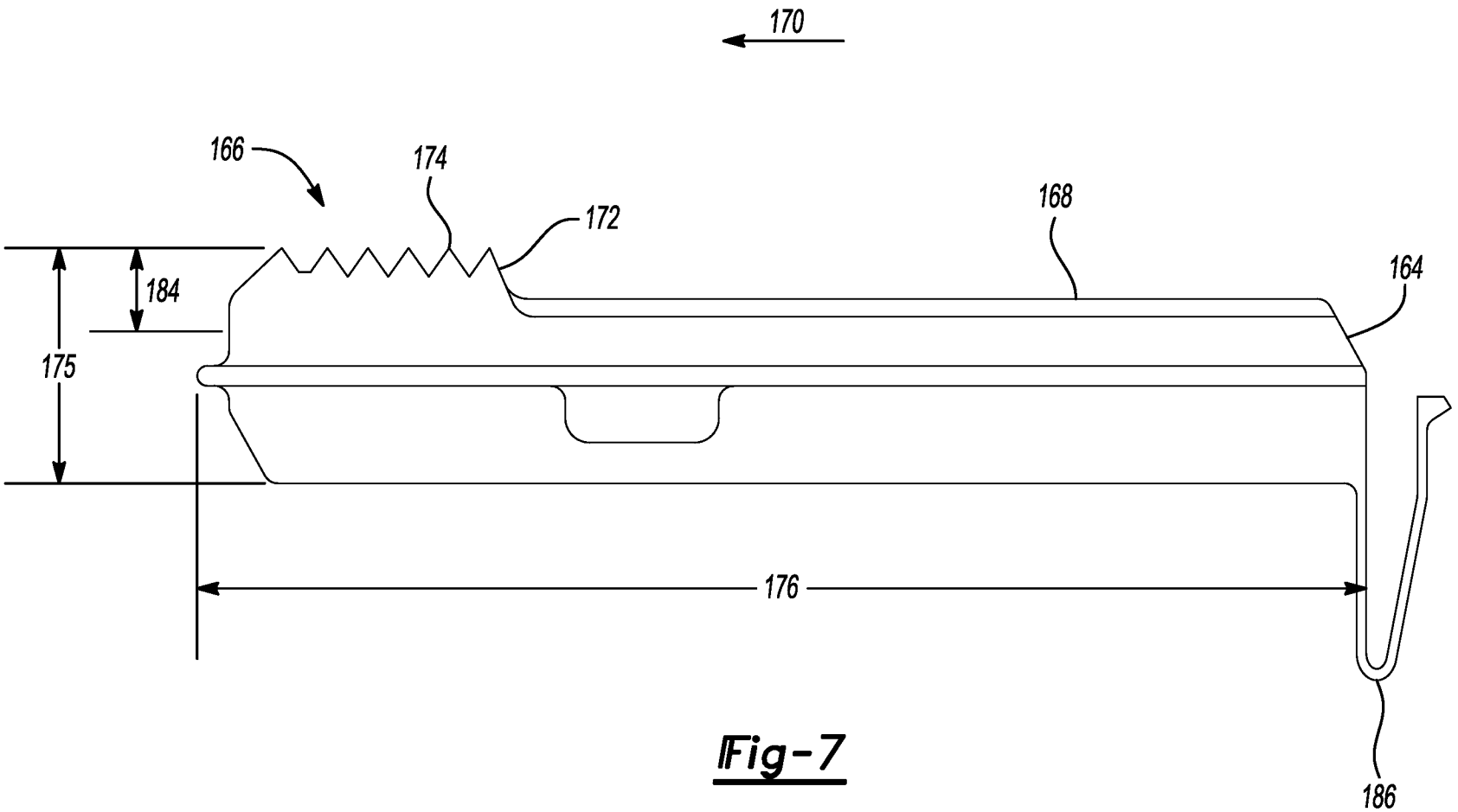
FIG. 7 is a side diagram of a separator module in the cash dispenser in accordance with one or more exemplary embodiments.

Referring to FIG. 7, a side diagram of an example implementation of the separator module 164 is shown in accordance with one or more exemplary embodiments. The separator module 164 may be representative of the first separator module 164*a* and/or the second separator module 164*b*. The separator module 164 generally includes a rough surface 166, a smooth surface 168, a nonplanar ridge 172 with a ridge height 184, multiple shapes 174 on the nonplanar ridges 172, and a clip 186. The separator module 164 may have a module height 175 of several millimeters.

A side of the separator module 164 opposite the floor 142 of the cash cassette 130 generally has the smooth surface 168 and the rough surface 166. As the notes 132 are pushed in the bias direction 170 onto the separator module 164 by the push plate 162, the particular note edges 135 of the notes 132 initially contact the smooth surface 168. As the notes 132 continue to move across the separator module 164, the notes engage the rough surface 166 portion of the separator module 164. The rough surface 166 is operational to fluff the notes 132 to aid in separating the individual notes 132 from the neighboring notes 132. The separation increases a probability that the pick-up module 152 pulls a single note 132 at time from the stack of notes 132.

The rough surface 166 is formed by one or more nonplanar ridges 172 that protrude up from the smooth surface 168 of the separator module 164. In various embodiments, two or more nonplanar ridges 172 running parallel to each other may be formed. In other embodiments, a single nonplanar ridge 172 may be provided on the separator module 164.

An upper surface of each nonplanar ridge 172 has a series of shapes 174. In various embodiments, the shapes 174 may be triangle shapes, teeth, ripples, and/or other features. The shapes 174 engage the predetermined note edges 135 as the notes 132 are pushed in the bias direction 170 toward the pick-up module 152. Each nonplanar ridge 172 has a ridge height 184. In various embodiments, the ridge height 184 may range from approximately 0.5 millimeters to approximately 2 millimeters. Other numbers of nonplanar ridges 172 and/or other ridge heights 184 may be implemented to meet a design criteria of a particular application.

The clip 186 may be disposed at an end of the separator module 164 opposite the nonplanar ridges 172. The clip 186 is operational to help align and secure the separator module 164 in a space in the floor 142 of the cash cassette 130.

Figure 8:
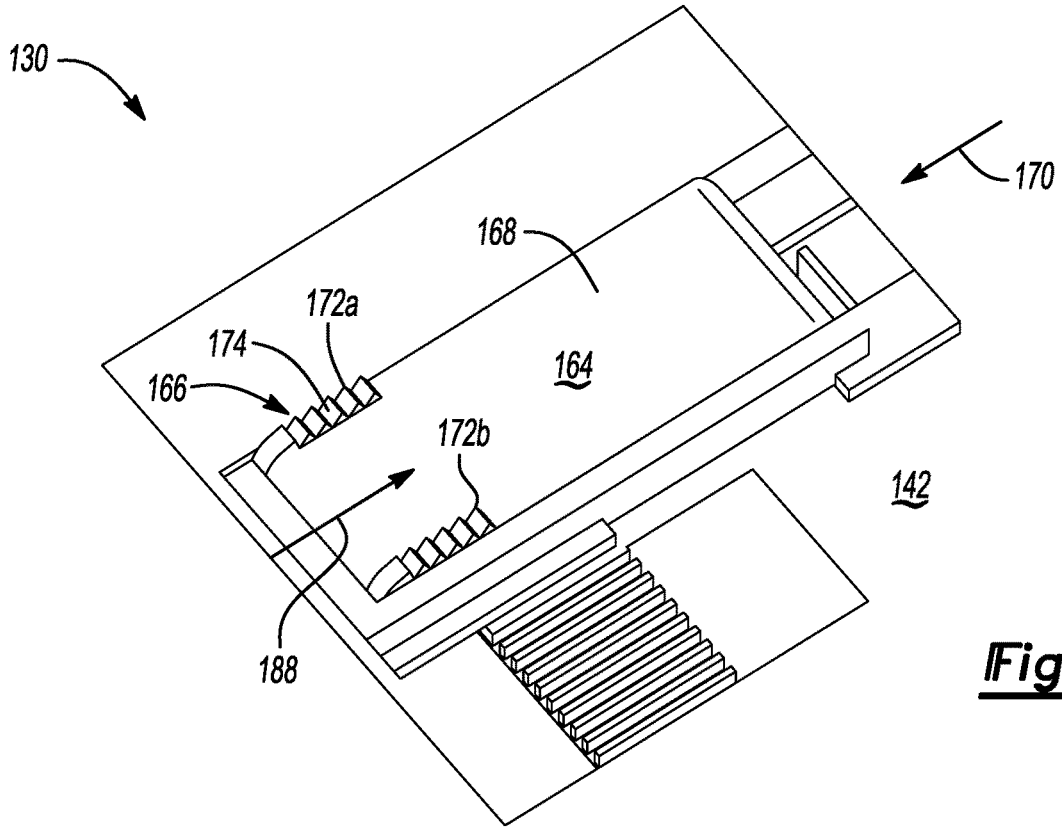
FIG. 8 is a perspective diagram of the separator module in accordance with one or more exemplary embodiments.

Referring to FIG. 8, a perspective diagram of an example embodiment of the separator module 164 is shown in accordance with one or more exemplary embodiments. The separator module 164 includes the rough surface 166, the smooth surface 168, and multiple (e.g., two) nonplanar ridges 172*a*-172*b*. The separator module 164 is secure to the floor 142 while the notes 132 traverse the separator module 164 in the bias direction 170.

In various embodiments, each nonplanar ridge 172*a* and 172*b* may be a copy of the nonplanar ridge 172. The nonplanar ridges 172*a* and 172*b* are disposed on opposite sides of the separator module 164. Each nonplanar ridge 172*a*-172*b* is oriented parallel to each other, and along a perpendicular direction 188 that extends from the dispense end 144 of the cash cassette 130. Each nonplanar ridge 172*a*-172*b* includes the shapes 174 that form the rough surface 166 that helps separate the notes 132 from each other as the notes 132 pass over the nonplanar ridges 172*a*-172*b*.

Figure 9:
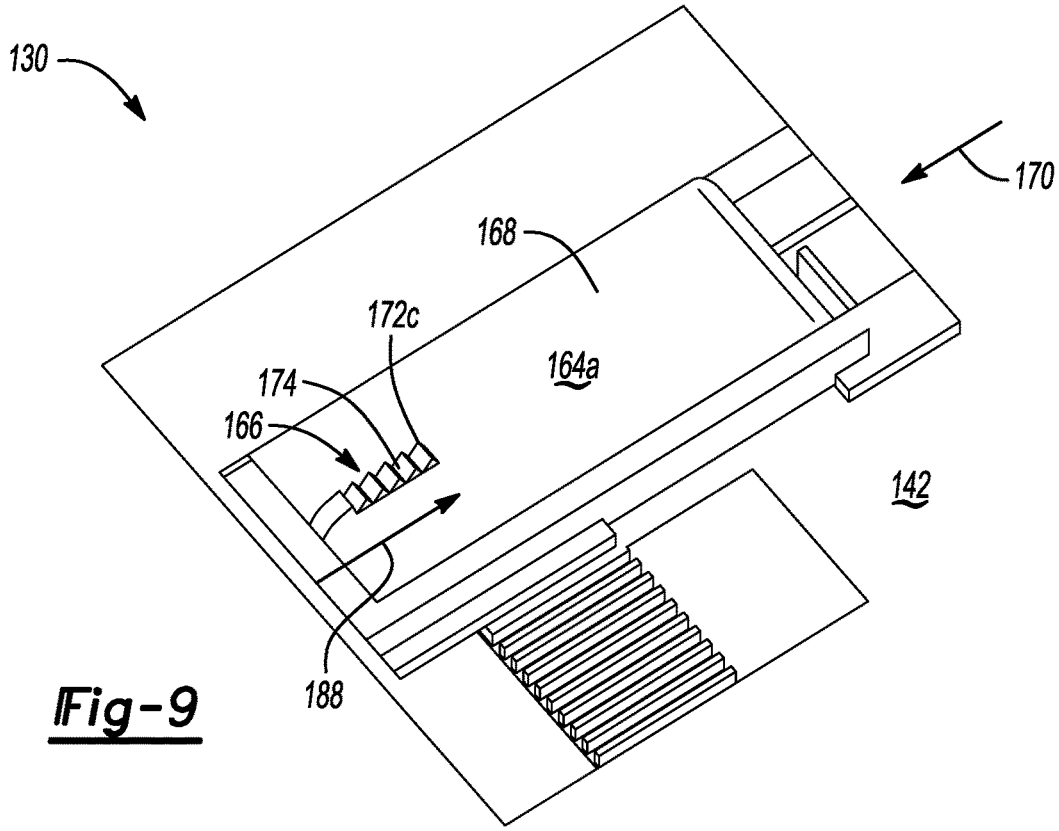
FIG. 9 is a perspective diagram of another separator module in accordance with one or more exemplary embodiments.

Referring to FIG. 9, a perspective diagram of an example embodiment of another separator module 164*a* is shown in accordance with one or more exemplary embodiments. The separator module 164*a* may be a variation of the separator module 164. The separator module 164*a* includes the rough surface 166, the smooth surface 168, a single nonplanar ridge 172*c*. The separator module 164 is secure to the floor 142 while the notes 132 traverse the separator module 164*a* in the bias direction 170.

The nonplanar ridge 172*c* is oriented along the perpendicular direction 188 that extends from the dispense end 144 of the cash cassette 130. The nonplanar ridge 172*c* includes the shapes 174 that form the rough surface 166 that helps separate the notes 132 from each other as the notes 132 pass over the nonplanar ridge 172.

Figure 10:
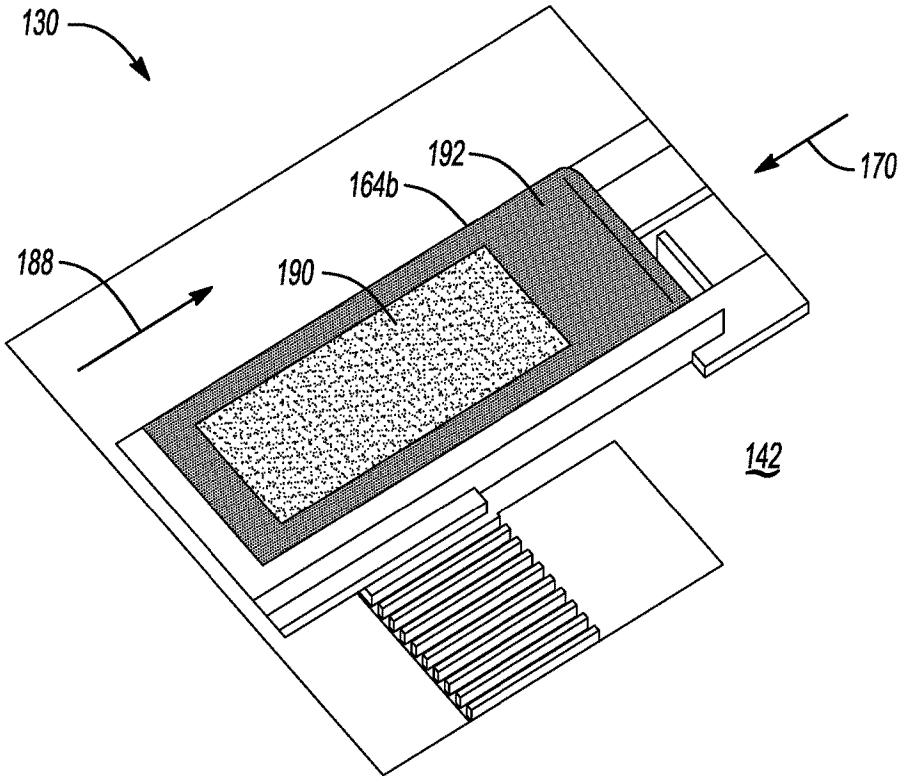
FIG. 10 is a perspective diagram of still another separator module in accordance with one or more exemplary embodiments.

Referring to FIG. 10, a perspective diagram of an example embodiment of still another separator module 164*b* is shown in accordance with one or more exemplary embodiments. The separator module 164*b* may implement a hook portion of a hook-and-loop fastener. The separator module 164*b* includes a patch of hooks 190 mounted on a strip 192. The strip 192 is generally attached to the floor 142 of the cash cassette 130.

The hooks 190 are operational to engage the particular note edges 135 to help separate the individual notes 132 from each other as the notes 132 move in the bias direction 170. The strip 192 implements a spacer that holds the hooks 190 at a proper height above the floor 142 so that the hooks 190 engage the notes 132. The hooks 190 and the strip 192 generally have a rectangular shape with a long edge oriented parallel to the perpendicular 188 that extends from the dispense end 144.

Figure 11:
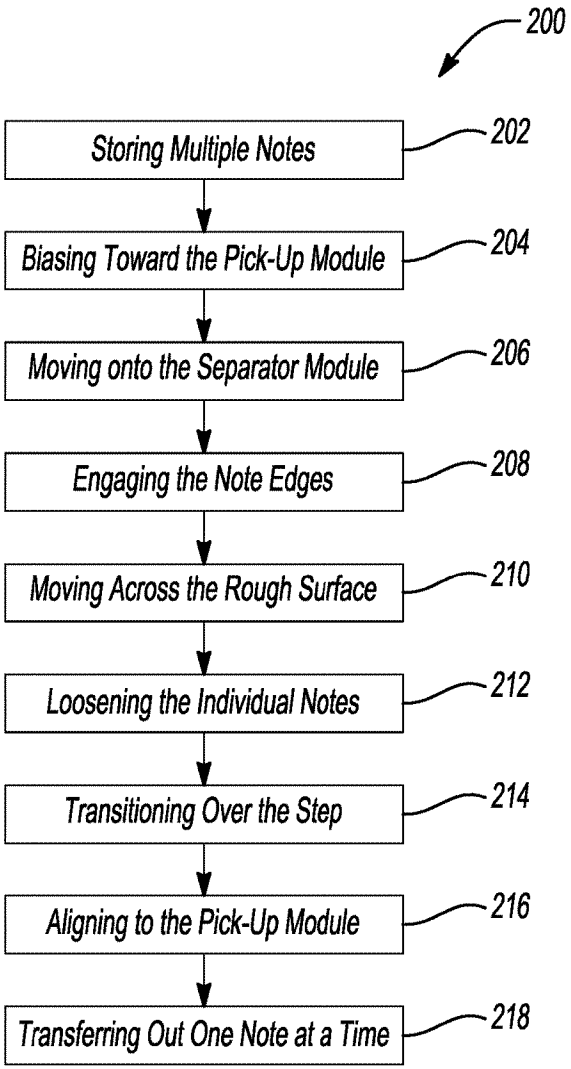
FIG. 11 is a flow diagram for a method of dispensing notes from the cash cassette in accordance with one or more exemplary embodiments.

Referring to FIG. 11, a flow diagram for an example implementation of a method 200 for dispensing the notes 132 from the cash cassette 130 is shown in accordance with one or more exemplary embodiments. The method (or process) 200 may be implemented by the cash cassettes 130. The method 200 includes a step 202, a step 204, a step 206, a step 208, a step 210, a step 212, a step 210, a step 214, a step 216, and a step 218. The sequence of steps is shown as a representative example. Other step orders may be implemented to meet the criteria of a particular application.

In the step 202, the multiple notes 132 may be stored in the housing 140 of the cash cassette 130 (e.g., inserted by the technician 86). The push plate 162 presses the notes 132 toward the dispense end 144 in the step 204. The notes 132 move in the bias direction 170 onto the separator module(s) 164 in the step 206. The rough surface 166 of the separator module(s) 164 engage the particular note edges 135 in the step 208 as the notes 132 are moved toward the dispense end 144.

In the step 210, the notes 132 move across the rough surface 166. As the particular note edges 135 move over the shapes 174 on the rough surface 166, the notes 132 are loosened from each other in the step 212. In the step 214, the notes 132 transition over (down) the step 171 between the separator module(s) 164 and the note guide 158. The alignment surface 160 of the note guide 158 aligns the notes 132 to the pick-up module 152 in the step 216. The pick-up module 152 transfers a single note 132 at time out of the cash cassette 130 in the step 218.

Table I illustrates environmental test results of the separator module 164 at various temperature and humidity conditions.

TABLE I

| Condition | Notes tested | Notes Rejected | Rejection percentage |
|---|---|---|---|
| Normal Temperature | 14,000 | 7 | 0.05% |
| High Temperature | 2,000 | 2 | 0.1% |
| Low Temperature | 2,000 | 0 | 0% |
| High Humidity | 2,000 | 11 | 0.55% |
| Low Humidity | 2,000 | 0 | 0% |
| Total | 22,000 | 20 | 0.09% |

The test results indicate that with the separator modules 164 installed, the automatic teller machines 100 have a reject rate at normal temperature that meets acceptable standards (e.g., 0.05%). An average rejection rate for harsh environmental conditions is lower than acceptable standards (e.g., 1%).

Embodiments of the disclosure provide a separator module 164 that creates frictional resistance against a bottom edge of the notes 132. The friction has been confirmed by performance tests not to impact dispensing of the notes 132 negatively. The separator modules 164 fit into openings in the cash cassettes 130 and have a clip 186 that allows the component to snap into the floor 142 of the cash cassette 130. The separator module 164 may be secured with a fastener (e.g., a screw or rivet). This molded separator module 164 generally provides a rough surface 166 that separates the notes 132 within a stack of notes 132. Test results show that by allowing the notes 132 to move across a rough, raised surface 166, note skew is reduced, and gap and length performance are increased.

The embodiments generally allow for field replacement of the separator modules 164, consistency in application, allows for notes 132 to separate without jams, and/or reduces reject rates due to new/low circulated notes 132. The technique avoids a risk to technicians when the notes 132 may be fanned manually with other equipment, such as a currency counter. While currency counters provide a positive result, the counters raise concerns surrounding technicians handling the notes 132 unnecessarily, loud equipment that consumes electrical power, security concerns of passing individuals, potential loss of notes 132 due to environmental situations on externally placed machines. By performing the separating action internally to the cash cassettes 130 automatically, the cash dispenser units 122 handle dispensing of the notes 132 of varying quality more successfully, thereby reducing technician time due to rejected bills.

While the best modes for carrying out the disclosure have been described in detail, those familiar with the art to which this disclosure relates will recognize various alternative designs and embodiments for practicing the disclosure within the scope of the appended claims.

What is claimed is:

1. A cash cassette comprising:

a housing that has a dispense end, a floor, and a size suitable to store a plurality of notes, wherein each of the plurality of notes has a particular note edge;

a pick-up module disposed at the dispense end of the housing and configured to transfer one note at a time among the plurality of notes out of the housing;

a push plate movably disposed inside the housing and configured to bias the plurality of notes against the pick-up module; and one or more separator modules disposed on the floor of the housing proximate to the pick-up module, wherein each of the one or more separator modules has a rough surface, the rough surface engages the particular note edge of the plurality of notes as the plurality of notes are pushed onto the one or more separator modules by the push plate, and the rough surface loosens individual notes among the plurality of notes from each other as the plurality of notes move across the one or more separator modules toward the pick-up module.

2. The cash cassette according to claim 1, further comprising a note guide disposed on the floor of the housing between the pick-up module and the one or more separator modules, wherein the note guide has an alignment surface that contacts the particular note edge of the plurality of notes, and the alignment surface aligns the plurality of notes to the pick-up module.

3. The cash cassette according to claim 2, wherein a step exists between the rough surface of the one or more separator modules and the alignment surface of the note guide, and the particular note edge of the plurality of notes transition over the step as the plurality of notes move toward the pick-up module.

4. The cash cassette according to claim 1, wherein the one or more separator modules is two separator modules.

5. The cash cassette according to claim 1, wherein the rough surface of each of the one or more separator modules comprise one or more nonplanar ridges oriented perpendicular to the dispense end.

6. The cash cassette according to claim 5, wherein each of the one or more nonplanar ridges comprises a series of shapes that loosen the individual notes.

7. The cash cassette according to claim 5, wherein the one or more nonplanar ridges is two nonplanar ridges disposed on opposite sides of each of the one or more separator modules, and at a same distance from the dispense end.

8. The cash cassette according to claim 1, wherein the rough surface of each of the one or more separator modules comprise a plurality of hooks attached to a strip, and the plurality of hooks form the rough surface that loosen the individual notes.

9. The cash cassette according to claim 1, wherein the cash cassette is removably connectable to a cash dispenser unit of an automatic teller machine.

10. A method for dispensing from a cash cassette comprising:

storing a plurality of notes in a housing of the cash cassette, wherein the housing has a dispense end and a floor, and each of the plurality of notes has a particular note edge;

biasing the plurality of notes toward a pick-up module with a push plate, wherein the pick-up module is disposed inside the housing at the dispense end, and the push plate is moveably disposed inside the housing;

engaging the particular note edge of the plurality of notes with a rough surface on each of one or more separator modules as the plurality of notes are pushed onto the one or more separator modules by the push plate, wherein the one or more separator modules is disposed on the floor of the housing proximate to the pick-up module; and loosening individual notes among the plurality of notes from each other with the rough surface as the plurality of notes move across the one or more separator modules toward the pick-up module; and transferring one note at a time among the plurality of notes out of the housing with the pick-up module.

11. The method according to claim 10, further comprising:

aligning the plurality of notes to the pick-up module with a note guide, wherein the note guide is disposed on the floor of the housing between the pick-up module and the one or more separator modules, and the note guide has an alignment surface that contacts the particular note edge of the plurality of notes.

12. The method according to claim 11, further comprising:

transitioning the particular note edge of the plurality of notes over a step between the rough surface of the one or more separator modules and the alignment surface of the note guide as the plurality of notes move toward the pick-up module.

13. The method according to claim 10, wherein the one or more separator modules is two separator modules.

14. The method according to claim 10, wherein the rough surface of each of the one or more separator modules comprise one or more nonplanar ridges oriented perpendicular to the dispense end.

15. The method according to claim 14, wherein the loosening of the individual notes comprises:

loosening the individual notes of the plurality of notes with a series of shapes on each of the one or more nonplanar ridges.

16. The method according to claim 15, wherein the one or more nonplanar ridges is two nonplanar ridges disposed on opposite sides of each of the one or more separator modules, and at a same distance from the dispense end.

17. The method according to claim 10, wherein the loosening of the individual notes comprises:

loosening the individual notes of the plurality of notes with a plurality of hooks that form the rough surface.

18. A cash dispenser unit comprising:

a body module configured to dispense one or more notes of a plurality of notes, wherein each of the plurality of notes has a particular note edge;

a feed module connectable to the body module, and configured to transfer the one or more notes to the body module; and one or more cash cassettes removably connectable to the feed module, wherein each of the one or more cash cassettes includes:

a housing that has a dispense end, a floor, and a size suitable to store the plurality of notes;

a pick-up module disposed at the dispense end of the housing and configured to transfer one note at a time among the plurality of notes out of the housing to the feed module;

a push plate movably disposed inside the housing and configured to bias the plurality of notes against the pick-up module; and one or more separator modules disposed on the floor of the housing proximate to the pick-up module, wherein the each of the one or more separator modules has a rough surface, the rough surface engages the particular note edge of the plurality of notes as the plurality of notes are pushed onto the one or more separator modules by the push plate, and the rough surface loosens individual notes among the plurality of notes from each other as the plurality of notes move across the one or more separator modules toward the pick-up module.

19. The cash dispenser unit according to claim 18, further comprising a present module connectable to the body module, and configured to transfer the one or more notes from the body module out of the cash dispenser unit.

20. The cash dispenser unit according to claim 19, wherein the body module, the feed module, and the present module form part of an automatic teller machine.

* * * * *